US009351622B2

(12) United States Patent
Bruders et al.

(10) Patent No.: US 9,351,622 B2
(45) Date of Patent: May 31, 2016

(54) FLUID EXTRACTING DEVICE WITH SHAPED HEAD AND ASSOCIATED SYSTEMS AND METHODS OF USE AND MANUFACTURE

(71) Applicant: Sapphire Scientific, Prescott, AZ (US)

(72) Inventors: William Bruders, Sedro Woolley, WA (US); Brett Bartholmey, Bellingham, WA (US)

(73) Assignee: Sapphire Scientific Inc., Prescott, AZ (US)

( * ) Notice: Subject to any disclaimer, the term of this patent is extended or adjusted under 35 U.S.C. 154(b) by 211 days.

(21) Appl. No.: 13/844,157

(22) Filed: Mar. 15, 2013

(65) Prior Publication Data

US 2014/0060577 A1 Mar. 6, 2014

Related U.S. Application Data

(60) Provisional application No. 61/696,721, filed on Sep. 4, 2012.

(51) Int. Cl.
*A47L 11/40* (2006.01)
*A47L 11/34* (2006.01)

(52) U.S. Cl.
CPC ..... *A47L 11/4044* (2013.01); *A47L 11/34* (2013.01); *A47L 11/4036* (2013.01)

(58) Field of Classification Search
CPC . A47L 11/34; A47L 11/4088; A47L 11/4044; A47L 11/4083; A47L 11/4075; A47L 11/4036; A47L 11/30; A47L 11/4077
USPC ..... 15/320, 321, 322, 347, 352
See application file for complete search history.

(56) References Cited

U.S. PATENT DOCUMENTS 855,433 A 5/1907 Freeman
896,290 A 8/1908 Freeman
(Continued)

FOREIGN PATENT DOCUMENTS

AU 656114 B3 1/1995
AU 664947 B2 12/1995
(Continued)

OTHER PUBLICATIONS

U.S. Appl. No. 29/100,084, Blackburn.
(Continued)

*Primary Examiner* — Robert Scruggs
(74) *Attorney, Agent, or Firm* — Perkins Coie LLP

(57) ABSTRACT

A fluid extracting device with a shaped head and associated systems and methods of use and manufacture. In one embodiment, the device includes an extractor head that includes an extractor port housing having a cavity configured to be coupled to a vacuum source. The extractor port housing includes a recessed surface and individual openings extending through the recessed surface and in fluid communication with an interior suction cavity. The extractor port housing can further include first and second lips each adjacent to opposite sides of the recessed surface and each configured to provide a squeegee function. In another embodiment, the device includes a tubular member and a handle operably coupled to the tubular member and including a suction control device. The suction control device is configured such that a user can simultaneously operate the device to control the suction and operate the extractor to remove fluid from a flooring surface.

19 Claims, 8 Drawing Sheets

(56) References Cited

U.S. PATENT DOCUMENTS 930,134 A 8/1909 Blackall
933,003 A 8/1909 Smith
1,016,435 A 2/1912 Overholt
1,042,711 A 10/1912 Moorhead
1,604,774 A 10/1926 Scheffer
1,661,553 A 3/1928 Baar
1,703,551 A 2/1929 Singer
1,787,916 A 1/1931 Polson et al.
1,821,715 A 9/1931 Kuchinsky
1,929,345 A 10/1933 Brown et al.
1,992,238 A 2/1935 Rose
2,081,597 A 5/1937 Nowak
2,156,890 A 5/1939 Wuringer
2,164,392 A 7/1939 Ellis
2,210,030 A 8/1940 Ellis
2,219,802 A 10/1940 Bjorkman
2,240,005 A 4/1941 Moyer
2,276,944 A 3/1942 Dow
2,280,751 A * 4/1942 Davis ..... 15/1.51
2,533,697 A 12/1950 Stewart
2,554,238 A 5/1951 Burrl
2,624,063 A 1/1953 Van Der Heem
2,703,905 A 3/1955 Faith-Ell
2,719,596 A 10/1955 Kent et al.
2,785,432 A 3/1957 Rockwell
2,799,040 A 7/1957 Hageal
2,822,061 A 2/1958 Pettit et al.
3,029,463 A 4/1962 Bishop
3,065,491 A 11/1962 Amador
3,072,951 A 1/1963 Kelnhofer
3,134,128 A 5/1964 Campbell
3,169,843 A 2/1965 Campbell
3,286,368 A 11/1966 Thomas
3,324,846 A 6/1967 Smith
3,345,672 A 10/1967 La Mers et al.
3,375,540 A 4/1968 Hyde
3,506,747 A 4/1970 Creskoff
3,571,841 A * 3/1971 Crouser ..... 15/401
3,594,849 A 7/1971 Coshow
3,605,171 A 9/1971 Candor et al.
3,619,848 A 11/1971 Salzmann
3,624,668 A 11/1971 Krause
3,689,956 A 9/1972 Melreit
3,697,771 A 10/1972 Colt
3,701,343 A 10/1972 Bowers
3,708,824 A 1/1973 Holubinka
3,739,422 A 6/1973 Johnson et al.
3,739,483 A 6/1973 Meier-Windhorst
3,761,997 A 10/1973 Frazier
3,771,193 A 11/1973 Hageal
3,774,261 A 11/1973 Colt
3,780,398 A 12/1973 Candor
3,786,531 A 1/1974 Borg
3,800,359 A 4/1974 Howard et al.
3,895,407 A 7/1975 Parise
3,919,729 A 11/1975 Cannan
3,950,815 A 4/1976 Fukuchi et al.
3,958,298 A 5/1976 Cannan
3,964,925 A 6/1976 Burgoon
4,000,538 A 1/1977 Tissier
4,013,039 A 3/1977 Kubilius et al.
4,074,387 A 2/1978 Arato et al.
4,095,309 A 6/1978 Sundheim
D248,763 S 8/1978 Muller
4,109,340 A 8/1978 Bates
4,133,072 A 1/1979 Face, Jr.
4,153,968 A 5/1979 Perkins
4,161,802 A * 7/1979 Knight et al. ..... 15/331
4,182,001 A 1/1980 Krause
4,203,714 A 5/1980 Wenander
4,207,649 A 6/1980 Bates
4,227,316 A 10/1980 Schneider
4,264,999 A 5/1981 Monson
4,270,238 A 6/1981 Shallenberg et al.
4,275,478 A 6/1981 Kohlenberger
4,279,057 A 7/1981 Restivo
4,284,127 A 8/1981 Collier et al.
4,308,636 A 1/1982 Davis
4,334,336 A 6/1982 Harbeck et al.
4,335,486 A 6/1982 Kochte
4,336,627 A 6/1982 Bascus
4,339,840 A 7/1982 Monson
4,373,226 A 2/1983 Lubnitz
4,391,017 A 7/1983 Bruensicke
4,391,619 A 7/1983 Shono et al.
4,413,372 A 11/1983 Berfield
4,441,229 A 4/1984 Monson
4,443,909 A 4/1984 Cameron
4,475,264 A 10/1984 Schulz
4,475,265 A 10/1984 Berfield
4,488,329 A 12/1984 Lackenbach
4,531,928 A 7/1985 Ikenoya
4,542,556 A 9/1985 Hepple
4,571,849 A 2/1986 Gardner et al.
4,580,309 A 4/1986 Ogden
4,584,736 A 4/1986 Gremminger
4,675,935 A 6/1987 Kasper et al.
4,677,705 A 7/1987 Schuster
4,692,959 A 9/1987 Monson
D295,092 S 4/1988 Mizuno et al.
4,759,155 A 7/1988 Shaw
4,862,551 A 9/1989 Martinez et al.
4,875,249 A 10/1989 Collier
4,879,784 A 11/1989 Shero
D306,788 S 3/1990 McAllister et al.
4,922,572 A 5/1990 Kohl et al.
4,934,017 A 6/1990 Kent
4,968,166 A 11/1990 Ingram
4,989,294 A 2/1991 Fischer
4,991,254 A 2/1991 Roden et al.
5,014,389 A 5/1991 Ogilvie et al.
5,032,184 A 7/1991 Ogilvie et al.
5,067,199 A 11/1991 Alazet
5,103,527 A 4/1992 Holland
5,134,748 A 8/1992 Lynn
5,152,026 A * 10/1992 Scarpine ..... 15/1.7
5,280,666 A 1/1994 Wood et al.
D345,234 S 3/1994 Iorli
5,392,490 A 2/1995 Monson
D361,178 S 8/1995 Piret
5,437,651 A 8/1995 Todd et al.
5,463,791 A 11/1995 Roden
5,485,651 A 1/1996 Payeur
5,485,652 A 1/1996 Holland
5,548,905 A 8/1996 Kuma et al.
5,555,595 A 9/1996 Ligman
5,593,091 A 1/1997 Harris
5,634,238 A 6/1997 McCaffrey et al.
D381,144 S 7/1997 Moine et al.
5,655,255 A 8/1997 Kelly
5,655,258 A 8/1997 Heintz
5,659,923 A 8/1997 Coombs
5,720,078 A 2/1998 Heintz
5,778,646 A 7/1998 Pfisterer
5,797,161 A 8/1998 Campbell
5,819,366 A 10/1998 Edin
5,870,797 A 2/1999 Anderson
5,891,198 A 4/1999 Pearlstein
5,911,260 A 6/1999 Suzuki
5,927,557 A 7/1999 Busick et al.
5,992,051 A 11/1999 Salehibakhsh
6,029,310 A 2/2000 Besel
6,047,437 A 4/2000 Suzuki
6,052,861 A 4/2000 Keller
D424,766 S 5/2000 Martin
6,076,597 A 6/2000 Manning et al.
6,080,243 A 6/2000 Insley et al.
6,101,667 A * 8/2000 Ishikawa ..... 15/319
6,136,098 A 10/2000 Tribastone
6,152,151 A 11/2000 Bolden et al.
6,182,328 B1 2/2001 Roden
6,195,907 B1 3/2001 Bodnar et al.
6,243,914 B1 6/2001 Studebaker
6,266,892 B1 7/2001 Haynie

(56) References Cited

U.S. PATENT DOCUMENTS

| | | | | |
|---|---|---|---|---|
| 6,290,097 | B1 | 9/2001 | Oakley | |
| 6,298,577 | B1 | 10/2001 | Haynie | |
| 6,355,112 | B1 | 3/2002 | Bartholmey et al. | |
| 6,381,803 | B1 | 5/2002 | Berfield et al. | |
| 6,421,875 | B1 | 7/2002 | Coombs et al. | |
| D468,499 | S | 1/2003 | Kitts | |
| 6,513,192 | B1 | 2/2003 | Pearlstein | |
| D479,636 | S | 9/2003 | Kitts | |
| 6,647,639 | B1 | 11/2003 | Storrer | |
| 6,675,437 | B1 | 1/2004 | York | |
| 6,981,338 | B2 | 1/2006 | Jensen et al. | |
| D518,259 | S | 3/2006 | Wertz | |
| D520,202 | S | 5/2006 | Dyson et al. | |
| D522,197 | S | 5/2006 | Dyson et al. | |
| 7,059,013 | B2 | 6/2006 | Wydra et al. | |
| 7,070,662 | B2 | 7/2006 | Studebaker | |
| 7,159,271 | B2 | 1/2007 | Sepke et al. | |
| D538,986 | S | 3/2007 | Ingram | |
| D565,262 | S | 3/2008 | Dyson et al. | |
| 7,392,566 | B2 | 7/2008 | Gordon et al. | |
| 7,469,727 | B2 | 12/2008 | Marshall | |
| 7,841,042 | B2 | 11/2010 | Roden et al. | |
| 7,870,639 | B2 | 1/2011 | Thomas | |
| D635,315 | S | 3/2011 | Wertz | |
| D643,169 | S | 8/2011 | Calvert | |
| 8,032,979 | B2 | 10/2011 | Boone | |
| D663,909 | S | 7/2012 | Andreesen | |
| 2002/0042965 | A1 | 4/2002 | Salem et al. | |
| 2002/0148066 | A1 | 10/2002 | Bullis | |
| 2002/0184729 | A1 | 12/2002 | Farina | |
| 2003/0041407 | A1 | 3/2003 | Savage | |
| 2004/0255484 | A1 | 12/2004 | Storrer et al. | |
| 2006/0196074 | A1 | 9/2006 | Vilhunen | |
| 2006/0207053 | A1 * | 9/2006 | Beynon | 15/321 |
| 2006/0282975 | A1 | 12/2006 | Basham et al. | |
| 2007/0039724 | A1 | 2/2007 | Trumbower et al. | |
| 2007/0061996 | A1 | 3/2007 | Boone | |
| 2007/0079472 | A1 | 4/2007 | Carter et al. | |
| 2008/0184520 | A1 | 8/2008 | Wolfe et al. | |
| 2008/0263812 | A1 | 10/2008 | Williams et al. | |
| 2009/0038105 | A1 | 2/2009 | Mayer | |
| 2009/0094784 | A1 | 4/2009 | Pedlar et al. | |
| 2009/0288685 | A1 | 11/2009 | Wolfe et al. | |
| 2010/0206344 | A1 | 8/2010 | Studebaker | |
| 2010/0223750 | A1 | 9/2010 | Kappos et al. | |
| 2010/0269932 | A1 | 10/2010 | Richmond | |

FOREIGN PATENT DOCUMENTS

| | | | |
|---|---|---|---|
| AU | 736546 | B2 | 8/2001 |
| CA | 02559485 | A1 | 9/2005 |
| CA | 02568203 | A1 | 12/2005 |
| GB | 663211 | A | 12/1951 |
| GB | 2145620 | A | 4/1985 |
| WO | WO-0106188 | A1 | 1/2001 |
| WO | WO-2005118959 | A1 | 12/2005 |

OTHER PUBLICATIONS

U.S. Appl. No. 29/431,162.

"TMF Review: Flash Xtractor by Waterclaw," http://www.youtube.com/watch?v=ts0xmTmBFsY, uploaded Jul. 2, 2010, 1 page.

"Water Claw debuts the FLASHXtractor," i Cleaning Specialist, http://www.icsmag.com/articles/print/water-claw-debuts-the-flashxtractor, Mar. 8, 2010, 1 page.

Dri-Eaz, "Rescue Mat System," <http://www.dri-eaz.com/VTC/RescueMat.html>, internet accessed on Jun. 20, 2005, 7 pages.

Injectidry Systems, Inc., "Product Page," <http://web.archive.org/web/20000520132110/www.injectidry.com/product.htm>, internet accessed on May 20, 2005, 3 pages.

Injectidry Systems, Inc., "Vac-It Panels," <http://web.archive.org/web/20021222211319/www.injectidry.com/vpanel.htm>, internet accessed on Jun. 20, 2005, 2 pages.

JonDon, "DryPro Water Vac", <http://www.jondon.com>, internet accessed on Apr. 2, 2010, 2 pages.

International Search Report and Written Opinion for International Patent Application No. PCT/US2013/057863, Applicant: Sapphire Scientific, Inc., mailed Nov. 26, 2013, 10 pages.

U.S. Products, "The Flood King—Portable Water Extractor for Restoration," Instant 212° F Heat at the Wand Tip, http://www.usproducts.com/products/restoration/floodking.htm, accessed Aug. 17, 2011, 1 page.

* cited by examiner

FLUID EXTRACTING DEVICE WITH SHAPED HEAD AND ASSOCIATED SYSTEMS AND METHODS OF USE AND MANUFACTURE

TECHNICAL FIELD

The following disclosure relates generally to devices and methods for extracting fluid from flooring such as carpeting.

BACKGROUND

Vacuum sources or pumps are frequently used to remove water or other fluids from flooring such as carpeting. For example, vacuums are often used to extract water from carpeting in homes and buildings that have been flooded due to heavy rains, a broken pipe, sprinklers that are activated in response to a fire, etc. Vacuums are also used to extract water from carpeting that has been saturated with water or cleaning solutions to clean the carpeting. Removing as much water and/or other fluid as possible from the carpeting helps the carpeting dry and prevents mold, unpleasant odors, and/or other undesirable consequences from wet carpeting. To remove the fluid from carpeting and/or any padding beneath the carpeting, vacuum sources are typically connected to a vacuum line and nozzle to provide an interface with the carpeting.

DETAILED DESCRIPTION

The present disclosure is directed generally to extractors and associated systems methods for removing water and/or other fluids (e.g., liquids) from flooring, such as carpeting and/or underlying padding. Although embodiments included herein are described with reference to carpeting and/or padding, one of ordinary skill in the relevant art will appreciate that the embodiments described herein can be used with various other types of flooring surfaces and materials. In addition, the following description identifies specific details with reference to FIGS. 1-8C to provide a thorough understanding of various embodiments of the disclosure. Other details describing well-known structures or processes often associated with extractors are not described below to avoid unnecessarily obscuring the description of the various embodiments of the disclosure. Moreover, although the following disclosure sets forth several embodiments of different aspects of the present technology, other embodiments can have configurations and/or components different than those described in this section. In addition, further embodiments of the technology may be practiced without several of the details described below, while still other embodiments may be practiced with additional details and/or features.

Figure 1:
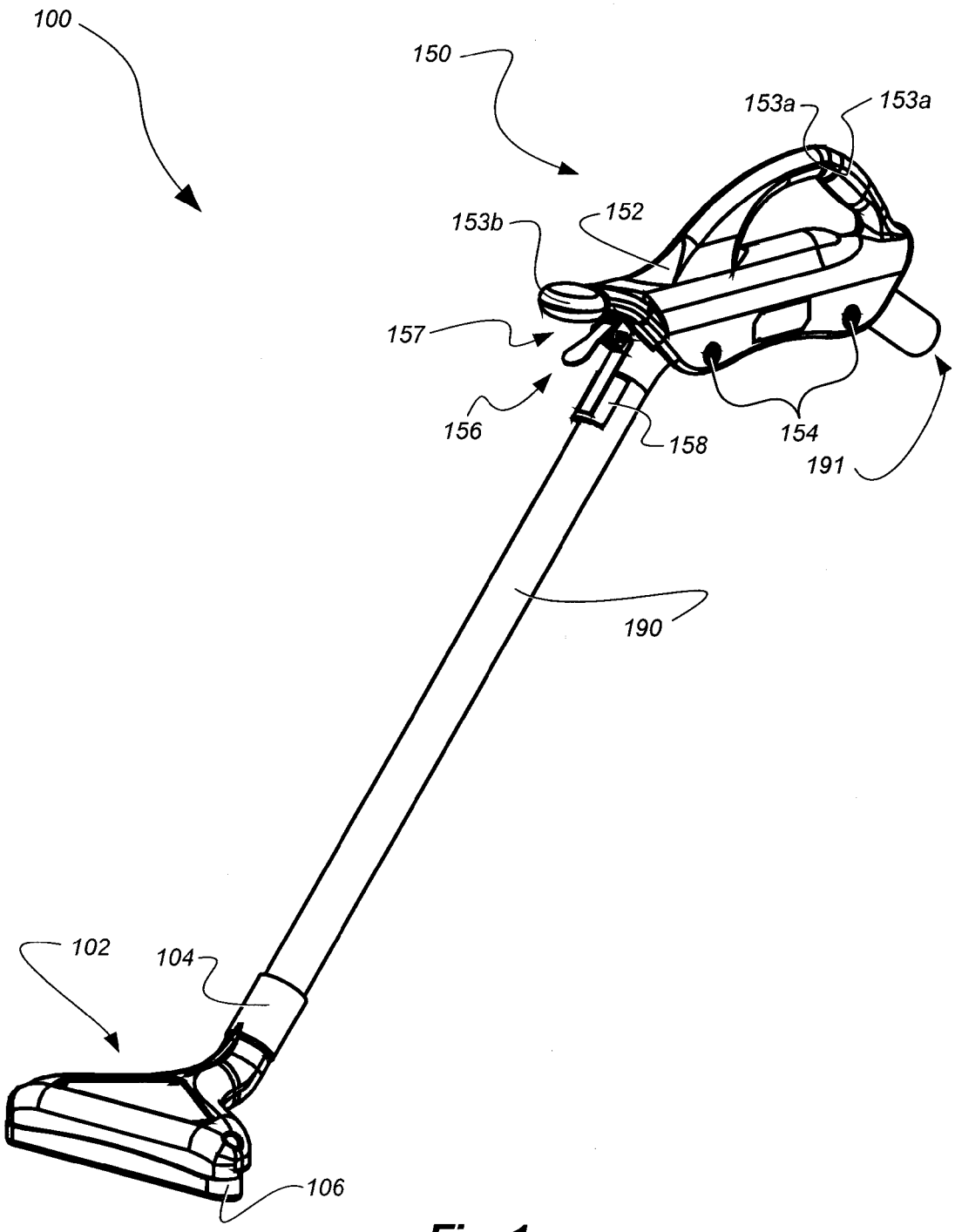
FIG. 1 is an isometric side view of an extractor configured in accordance with an embodiment of the present disclosure.

FIG. 1 is an isometric side view of an extractor 100 configured in accordance with an embodiment of the present disclosure. In the illustrated embodiment, the extractor 100 can have a "wand" configuration, e.g., so as to include an extractor head 102, a handle 150, and a tubular member 190 having an outlet 191 that is configured to be coupled to a vacuum source via a vacuum hose (not shown). The vacuum or suction source can be a truck or van-based vacuum source, as well as any other type of suitable vacuum source to create suction through the extractor head 102. The extractor head 102 includes a suction connector 104, an extractor port housing 106, and an internal suction cavity (not shown) that provides fluid communication between the suction connector 104 and the extractor port housing 106. The extractor head 102 can be configured to be connected to, as well as removed from, the tubular member 190 at the suction connector 104. The extractor port housing 106 is configured to interface with a flooring surface during operation of the extractor 100 (described further with reference to FIGS. 2-4B).

The handle 150 can have a handle body 152, one or more handle members 153 (e.g. a first handle member 153*a* and a second handle member 153*b*), fasteners 154, and a suction control device 157. The handle body 152 is shaped to accommodate the tubular member 190 and to carry the tubular member 190 and the extractor head 102 when the extractor head 102 is connected to the tubular member 190. The fasteners 154 can include screws, bolts, rivets, and/or other suitable elements for firmly holding the handle 150 in a fixed position such that the tubular member 190 does not move or rotate about the handle body 152. The handle members 153*a* and 153*b* are shaped and positioned so that a user or operator can comfortably hold the extractor 100 while operating the extractor 100. The handle members 153*a* and 153*b* can also be configured so that the user can hold the extractor 100 in multiple orientations. For example, the handle members 153*a* and 153*b* can be configured such that a user can hold the extractor 100 in a first orientation when operating the extractor 100 in a first direction and a second orientation when operating the extractor 100 in a second direction (as will be described later with reference to FIGS. 4A and 4B). In a particular embodiment, the extractor 100 can include two handle members 153*a* and 153*b*, and the user can grasp each one with one hand. In other embodiments, the extractor 100 can include a single handle member, or more than two handle members. In any of these embodiments, the handle member (s) can be positioned to allow the user to access the suction control device 157 during normal operation.

The suction control device 157 can include a lever 156 coupled to a plate 158 that is pivotally coupled to the handle body 152. The suction control device 157 is configured to control an amount of suction (or fluid flow rate) through the tubular member 190 and the extractor head 102 by varying the position of the plate 158 over one or more suction control openings below the plate 158 (described further with reference to FIGS. 5A-6C). The suction control device 157 can be positioned such that it can be controlled by a user who is operating the extractor 100. In certain embodiments, the suction control device 157 is positioned such that it can be controlled by a user while simultaneously operating the extractor 100, to remove fluid from a flooring surface. In still further embodiments, the suction control device 157 can be positioned to be controlled by the same hand that is carrying the extractor 100, such as with an index finger, thumb, or combination of the user's fingers of the hand that holds the second handle member 153*b*.

Figure 2B:
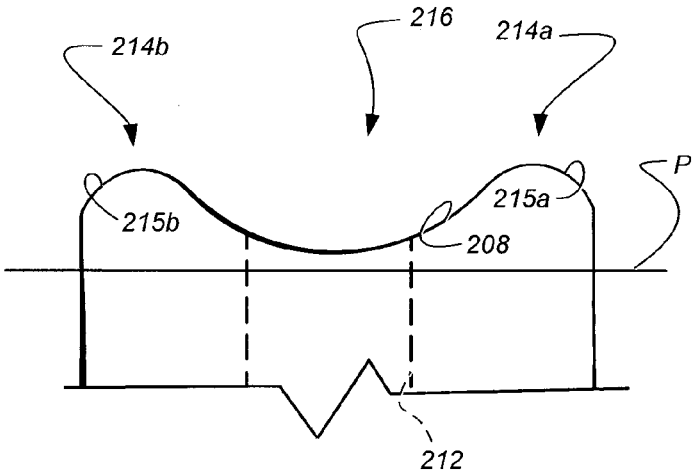
FIG. 2B is a partial cross-sectional side view of an embodiment of an extractor port housing of the extractor head shown in FIG. 2A.
Figure 2A:
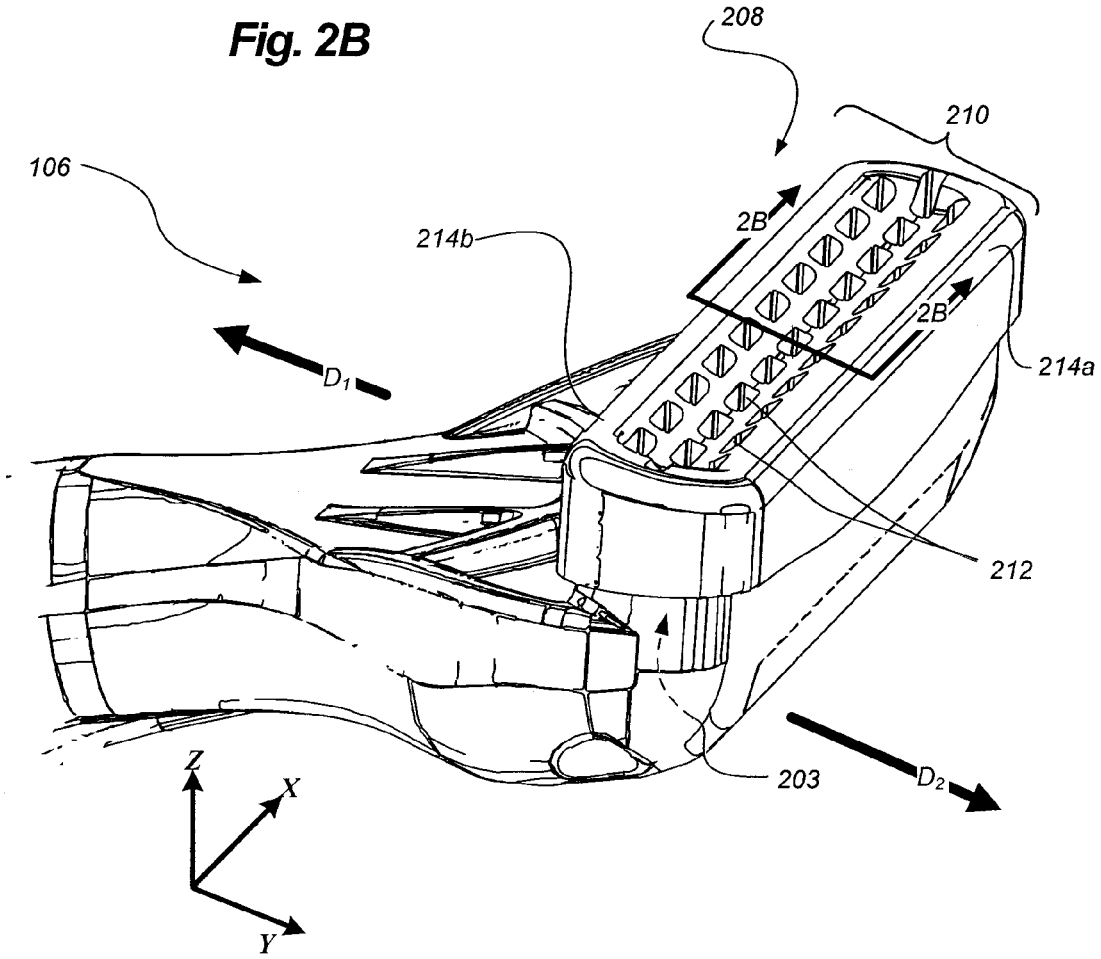
FIG. 2A is an isometric bottom view of an extractor head of the extractor shown in FIG. 1

FIG. 2A is an isometric bottom view of the extractor head 102, showing the extractor port housing 106. The extractor port housing 106 includes a recessed surface 208 generally aligned along an elongated axis (e.g., the X-axis), an array 210 or rows having individual openings 212, and first and second lips 214*a* and 214*b* adjacent the recessed surface 208 and generally aligned with the elongated axis. The individual openings 212 can have an elongated shape, can extend through the recessed surface 208, and are in fluid communication with an interior suction cavity 203 of the extractor head 102. In the illustrated embodiment, the rows of the array 210 are in a staggered configuration. In other embodiments, the rows of the array 210 and/or openings 212 can be configured differently. For example, embodiments may include more or fewer rows in an array and/or openings, rows and openings can be spaced differently, and/or rows and openings can have different shapes as will be discussed later with reference to FIG. 3. In general, the openings 212 provide suction that draws fluid from a flooring surface and into the interior suction cavity 203 of the extractor head 102. As will be described in more detail below, this suction may be enhanced in some embodiments by a squeegee function provided by the first and second lips 214*a* and 214*b* and the recessed surface 208.

The recessed surface 208 can be generally concave and can have a curved profile. FIG. 2B is a partial cross-sectional side view of the extractor port housing 106 that shows the curved profile of the recessed surface 208. In general, the curved profile defines a depression or crater 216 in the extractor port housing 106 that facilitates collecting fluid through the openings 212 (drawn in phantom). In some embodiments, the recessed surface 208 may have a different profile, curvature, or shape, such as a triangular, polygonal, or other geometric profile or shape. In other embodiments, the depression 216 may be shallower or deeper.

The first and second lips 214*a* and 214*b* in FIGS. 2A and 2B are generally convex relative to a flat plane P and the generally concave shape of the recessed surface 208. In the illustrated embodiment, the first and second lips 214*a* and 214*b* have curved surfaces 215*a* and 215*b*, respectively. In other embodiments, the first and second lips 214*a* and 214*b* can have different shapes or profiles. During operation, a user can position the first lip 214*a* and/or the second lip 214*b* at a desired location on a flooring surface. A vacuum source coupled to the extractor port housing 106 through the extractor head 102 creates suction through the openings 212 of the extractor port housing 106. The user can apply a force that causes the first lip 214*a* and/or the second lip 214*b* of the extractor port housing 106 to contact a flooring surface and at least partially seal the outer periphery of the extractor port housing 106 to the flooring surface. As the first lip 214*a* and/or the second lip 214*b* is pressed into the flooring surface, the fluid is compressed out of the carpeting of a flooring surface and/or padding beneath the carpeting. The suction in the extractor port housing 106 draws this fluid through the openings 212 to remove the fluid from the flooring surface.

In particular embodiments, the first and second lips 214*a* and 214*b* are also configured to provide an edge that controls the flow of liquid when the first lip 214*a* is in contact with a flooring surface and when the second lip 214*b* is in contact with the flooring surface. For example, the first and second lips 214*a* and 214*b* can control or direct the flow of liquid toward the depression 216 of the extractor port housing 106 when the extractor port housing 106 is operated under a vacuum. In one embodiment, the first and second lips 214*a* and 214*b* are positioned relative to the recessed surface 208 to provide a squeegee function that directs the fluid into the depression 216. A suction force, applied through the openings 212, can then remove the fluid that was directed toward the depression 216. For example, the first lip 214*a* and the recessed surface 208 can provide a squeegee function when the extractor head 102 is moved or operated in a first direction D1. In addition, the second lip 214*b* and the recessed surface 208 can provide a separate squeegee function when the extractor head 102 is moved or operated in a second direction D2 that is different than (e.g., opposite from) the first direction D1. In some embodiments, the first lip 214*a* has a different shape or size than the second lip 214*b* to enhance operation. In various embodiments, a small lip can enhance operation in one direction, while a larger lip can enhance operation in another direction.

Figure 3A:
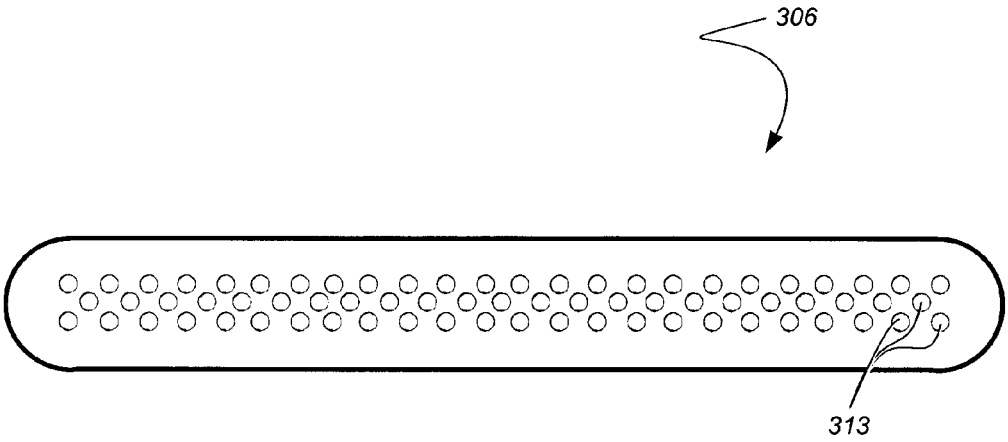
FIGS. 3A and 3B are bottom plan views of extractor port housings configured in accordance with another embodiment of the present disclosure.
Figure 3B:
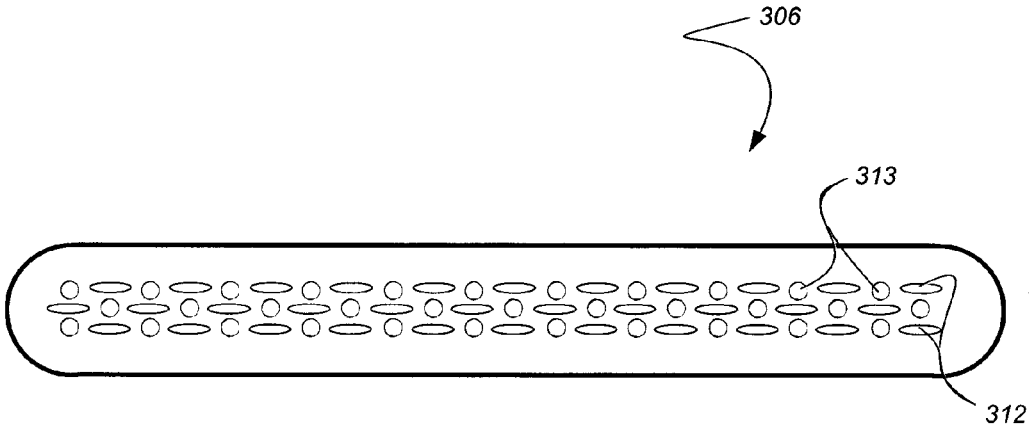

FIG. 3A, for example, shows an embodiment of an extractor port housing 306 having an array of rows with individual circular openings 313. FIG. 3B, as another example, shows the extractor port housing 306 having an array of rows with rectangular openings 312 in an alternating pattern with the circular openings 313. As shown, the rectangular openings 312 are less elongated than the openings 212 of FIG. 2A. In any of these embodiments, the lips can each provide a distinct squeegee function depending upon the direction in which the user moves the head as described further below with reference to FIGS. 4A and 4B.

Figure 4A:
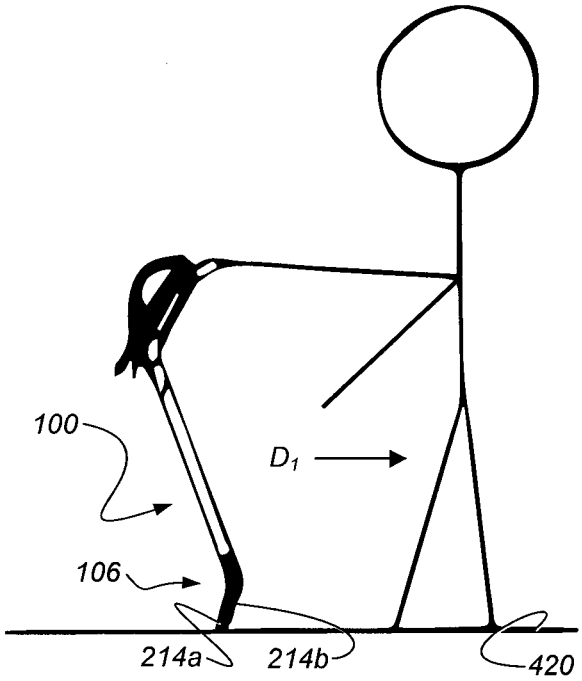
FIGS. 4A and 4B are cross-sectional side views illustrating representative embodiments of methods for operating the extractor head of FIGS. 2A and 2B.
Figure 4B:
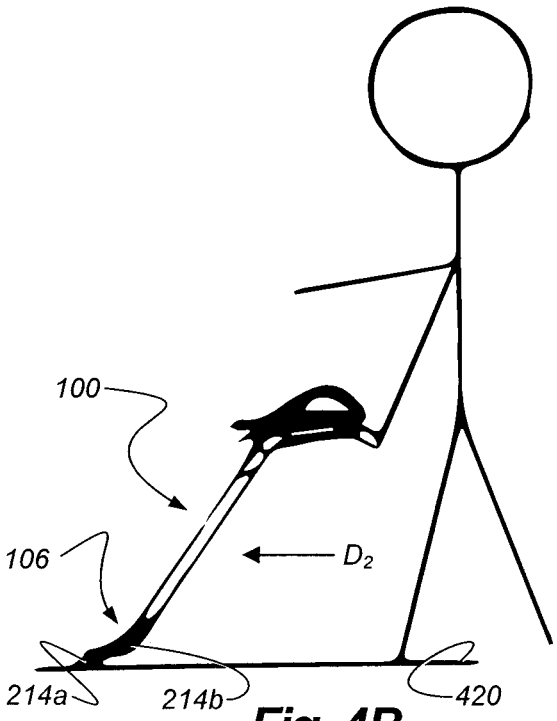

FIGS. 4A and 4B are cross-sectional side views of an embodiment for operating the extractor head 102 to remove fluid from a flooring surface 420 by providing a squeegee function. FIG. 4A shows the extractor head 102 being moved in a first direction D1 that is toward the user or operator (e.g., a back stroke motion). In this example, the first lip 214*a* provides a squeegee function. During operation, the first lip 214*a* provides an edge that contacts the flooring surface 420 while the second lip 214*b* is not in contact with the flooring surface 420 or has less contact force with the flooring surface 420. The edge of the first lip 214*a* controls or directs fluid from the flooring surface 420 toward the depression 216 (FIG. 2B) while contacting the flooring surface 420. FIG. 4B shows the extractor head 102 being moved in a second direction D2 that is away from the operator or user (e.g., a forward stroke motion). In this example, the second lip 214*b* provides a squeegee function. During operation, the second lip 214*b* provides an edge that contacts the flooring surface 420 while the first lip 214*a* is not in contact with the flooring surface 420 or has less contact force with the flooring surface 420. In this orientation, the edge at the second lip 214*b* control or directs fluid from the flooring surface 420 toward the depression 216 (FIG. 2B).

Conventional extractor heads, by contrast, do not allow for such fluid control, such as through a squeegee function. Rather, conventional extractor heads are generally required to be held in a single specific orientation during operation. Conventional extractor housings typically have a planar surface that must be maintained generally in parallel with the flooring surface during all phases of operation. If the conventional extractor head deviates from this orientation, the fluid removal efficacy of the device can decrease significantly.

Embodiments of the present disclosure, however, overcome these and other limitations of conventional extractor heads. As discussed above, the extractor head 102 provides a squeegee function that enhances fluid removal efficiency. In addition, the extractor head 102 can support and/or facilitate dynamically positioning and/or orientating the surfaces and openings it contains. In particular, the first and second lips 214*a* and 214*b* can have curved surfaces, forming multiple contact edges between a lip and the flooring surface 420 to create a seal or partial seal with the flooring surface. For example, shorter or taller users may position or orient the extractor head differently, while still maintaining an edge that contacts the flooring surface 420. Also, the position or orientation of the head can be varied depending on how vigorously or forcefully the user is applying the extractor head 102 at the flooring surface 420. Fluid removal efficacy can be enhanced by applying vertical and/or lateral force to the flooring surface 420 through the first lip 214*a* and/or the second lip 214*b*. In other embodiments, fluid control occurs while the extractor head 102 is stationary, but still maintains in contact with the flooring surface 420 through the first lip 214*a* or the second lip 214*b*.

In some embodiments, the extractor head 102 can be used in combination with the suction control device 157 (FIG. 1). For example, the user may want to reduce the amount of resistance created by the suction during one or both strokes. In one embodiment, the user may use the suction control device 157 to decrease the amount of suction through the extractor head 102 while moving the extractor head 102 in the first direction D1 (e.g., a back stroke motion) or the second direction D2 (e.g., a forward stroke motion). In other embodiments, the user can reduce the suction for lower nap carpeting, such as commercial grade carpeting. Suction control and adjustment may also be helpful for carpeting with a high concentration of air gaps. In any of these embodiments, the user can easily access the suction control device 157 during normal use, without adjusting the user's grip on the extractor 100, as will be described further below with reference to FIGS. 5A-5B.

Figures 5A, 5B:
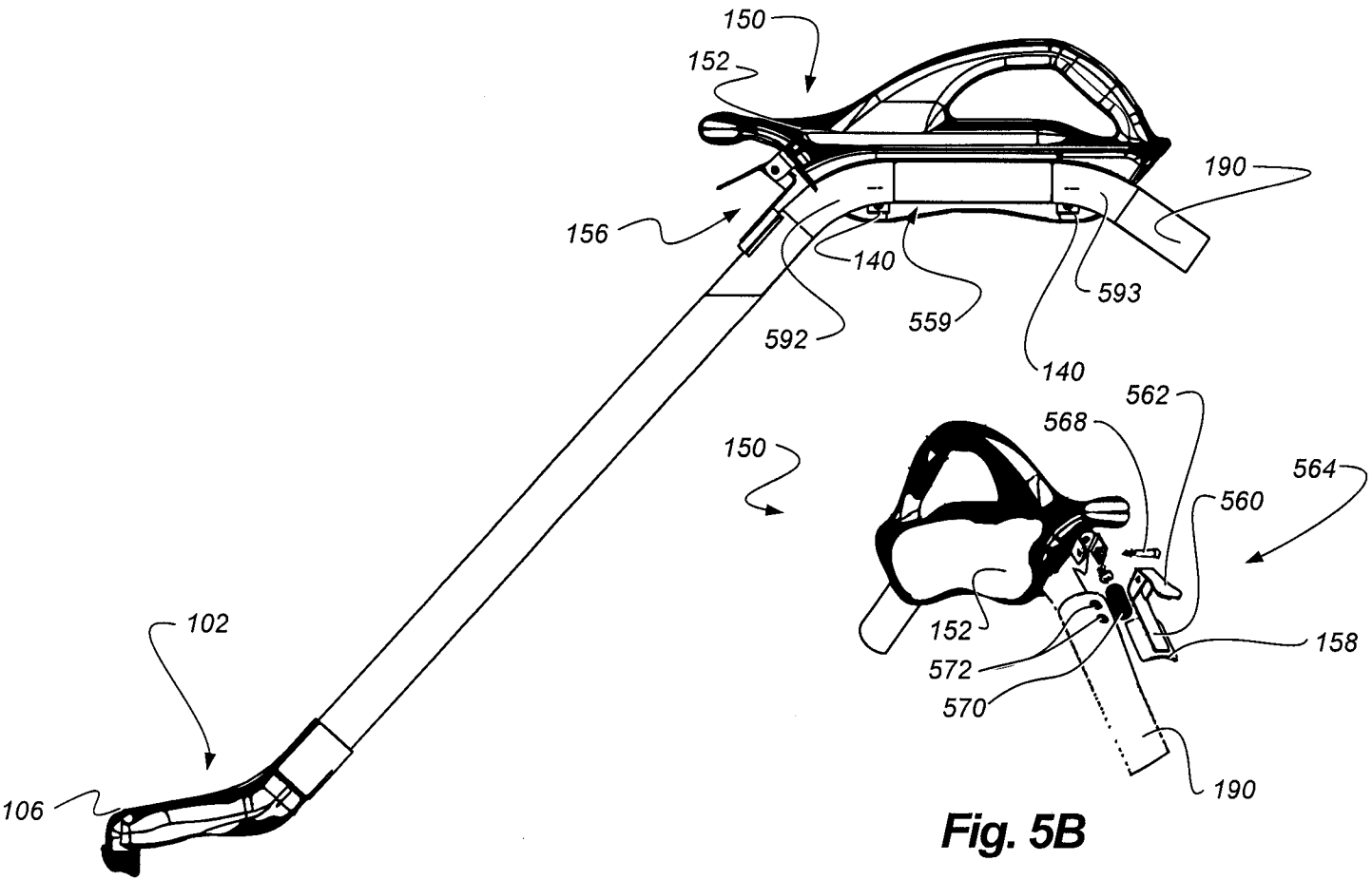
FIG. 5A is a cross-sectional side view of the extractor shown in FIG. 1, with a cutaway view of the handle.
FIG. 5B is a partial isometric top view of the handle, with an exploded view of a suction control lever.

FIG. 5A is a cross-sectional side view of the extractor 100, with a cutaway view of the handle 150. FIG. 5A shows a pass-through portion 559 of the handle 150 that is configured to accommodate the tubular member 190. The fasteners 140 can be configured to firmly hold a removable piece of the handle body 152. The tubular member 190 also includes bend portions 592 and 593 that position the tubular member 190 in the handle body 152 such that the tubular member 190 does not slide through the handle body 152.

FIG. 5B is a partial isometric top view of the handle 150 with an exploded view of the suction control device 157. The suction control device 157 includes the plate 158, a lever arm 560 coupled to the plate 158, and a finger tab 562 coupled to the lever arm 560. The plate 158 can have a generally curved shape that conforms to the curved shape of the tubular member 190. A hinge 564 pivotally couples the lever arm 560 and the finger tab 562 to the handle body 152. A pin 566 provides a pivot point for the hinge 564, and a screw 568 attaches the hinge 564 to the handle body 152. The finger tab 562 extends above the lever arm 560 and is positioned such that a user can control the position of the plate 158 while simultaneously holding and operating the extractor 100. As will be described in more detail below, the position of the plate 158 can control the amount of suction through the extractor head 102, including the extractor port housing 106. Accordingly, because the lever 156 is closely positioned to the handle body 152, a user can control the suction applied by the extractor 100 "on the fly," such as by pulling or releasing the finger tab 562. This allows a user to control the suction during an entire cleaning motion (e.g., during an entire motion that includes a forward and a back stroke motion). By contrast, conventional extractors typically do not allow for such control. Instead, a suction adjustment mechanism is typically located away from the handle, which means the user is required to stop operating the conventional extractor in order to set the suction adjustment.

Suction control in accordance with particular embodiments disclosed herein is provided by the combination of the lever 156 and suction control openings 572. The suction control openings 572 extend through the tubular member 190 and are in fluid communication with an interior portion of the tubular member 190. A gasket 570 is positioned on the tubular member 190 and is configured to form a seal between the tubular member 190 and the plate 158 when the lever 156 is in a closed position, or a partial seal when the lever 156 is in a partially opened position. The gasket 570 can include corresponding openings (not visible in FIG. 5B) that are aligned with the suction control openings 572. The gasket 570 can be made from an elastomeric material, such as rubber, neoprene, silicone, ethylene propylene diene monomer, or other material suitable for forming a seal. In the illustrated embodiment, the gasket 570 is attached to the tubular member 190. In other embodiments, the gasket 570 can be attached to the plate 158. In such an embodiment, the openings of the gasket 570 can be omitted.

In operation, the user controls the amount of suction provided by the extractor by changing the position of the plate 158 through operation of the lever 156. When the lever 156 is moved from the closed position to an open position, the plate 158 uncovers a portion of the suction control openings 572, which reduces the suction applied by the extractor head 102 extractor port housing. As the plate 158 is moved farther away from the gasket 570, a larger portion of the suction control openings 572 becomes uncovered, which diverts a larger amount of suction from the extractor head 102.

Figure 6A:
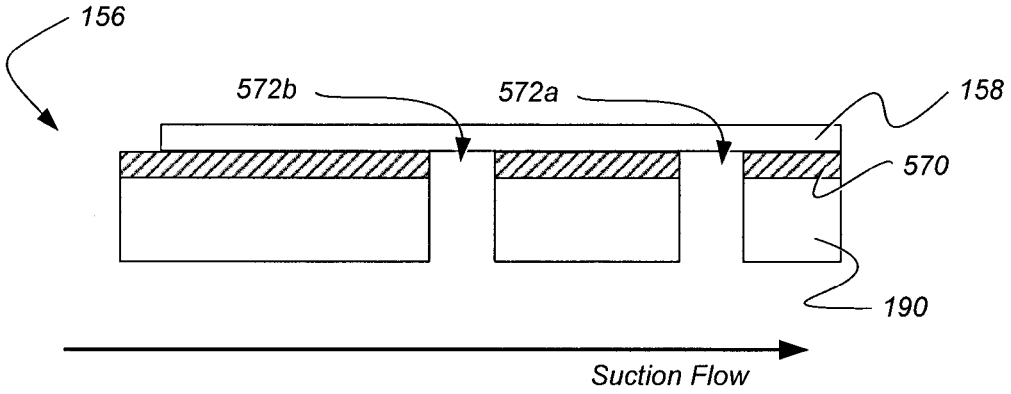
FIGS. 6A-6C are partial cross-sectional side views of the lever shown in FIGS. 5A and 5B in various stages of operation.
Figure 6B:
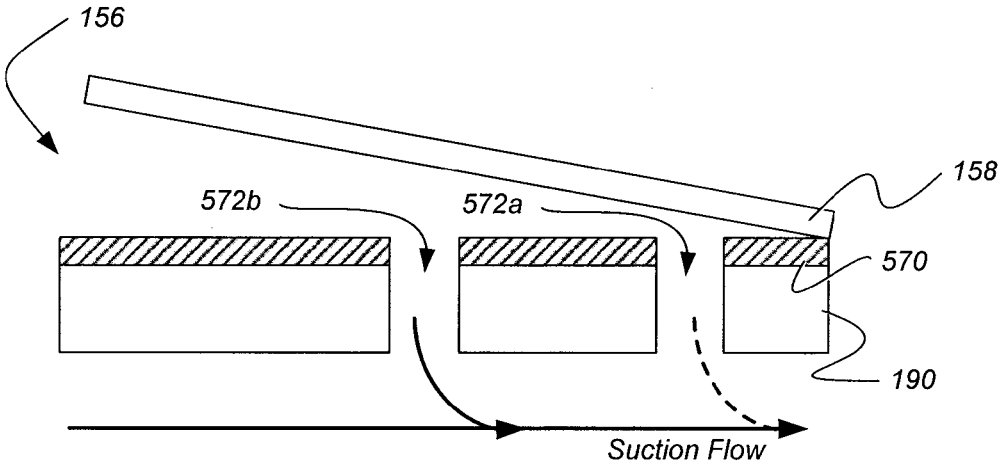
Figure 6C:
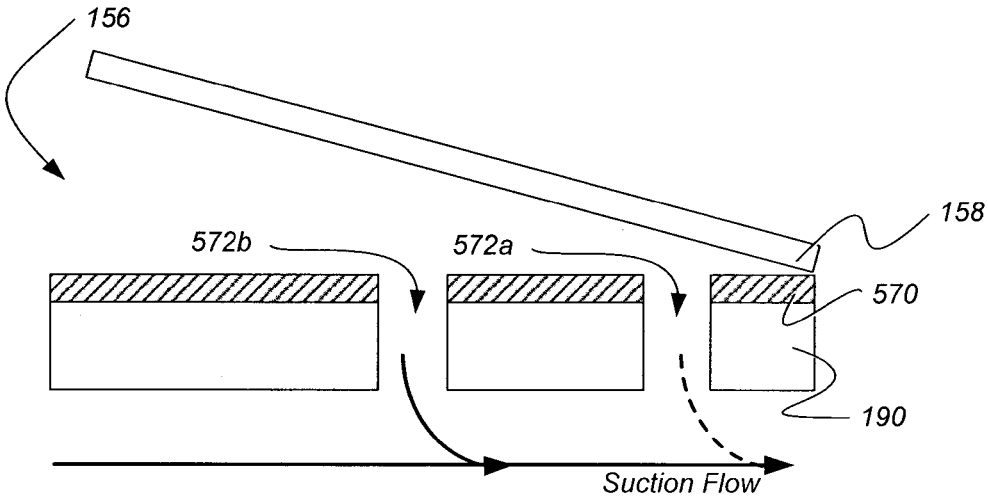
Figure 7A:
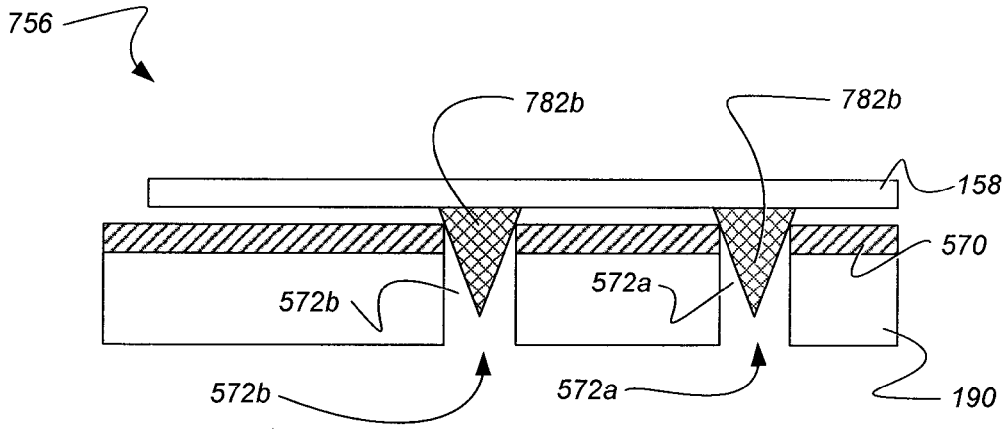
FIGS. 7A-8C are partial cross-sectional side views of other levers in various stages of operation in accordance with other embodiments of the present disclosure.
Figure 7B:
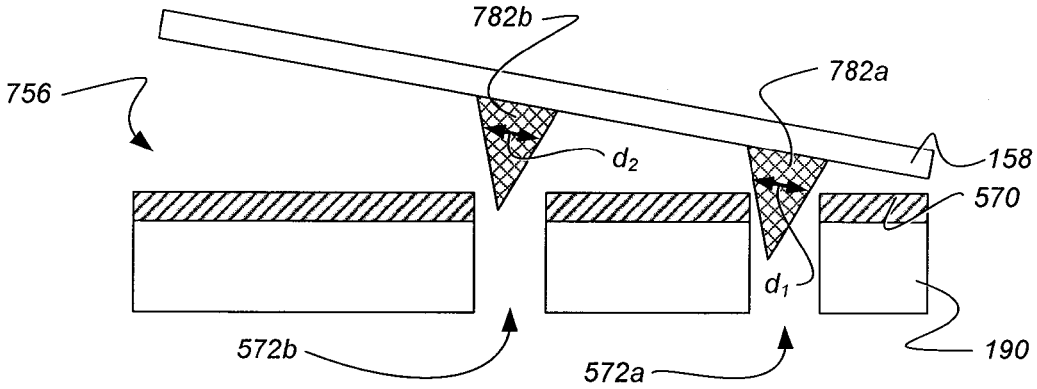
Figure 7C:
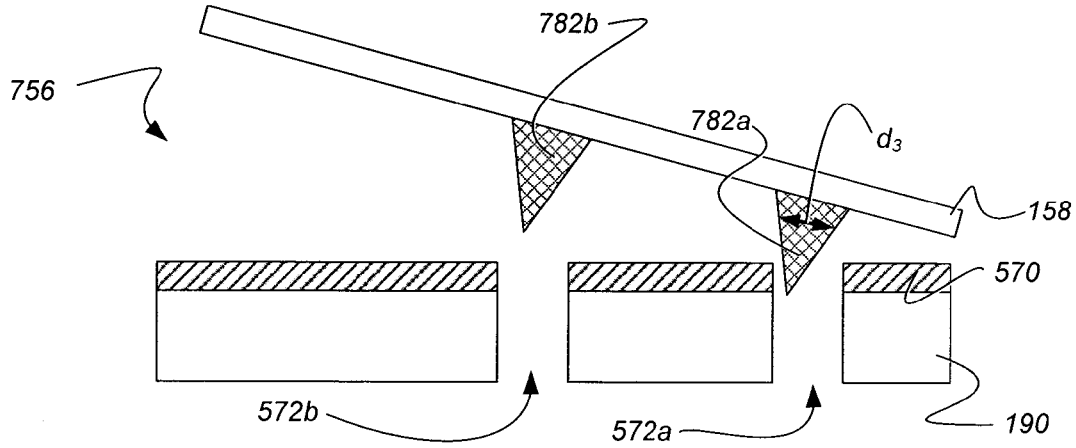

FIGS. 6A-6C are partial cross-sectional side views of the lever 156 in various stages of operation. FIG. 6A shows the plate 158 covering the gasket 570 and the suction control openings 572 (identified individually as first and second suction control openings 572*a* and 572*b*). In this configuration, the lever 156 is in a closed position and suction force is not diverted from the extractor head 102. FIG. 6B shows the lever 156 in a partially open position, with the plate 158 significantly blocking the first suction control opening 572*a* and less significantly blocking or not blocking the suction control opening 572*b*. FIG. 6C shows the lever 156 in an open position. In this configuration, the lever 156 is positioned such that the plate 158 is positioned to generally uncover the suction control openings 572*a* and 572*b* extractor port housing FIGS. 7A-8C are partial cross-sectional side views of other embodiments of levers in various stages of operation. FIGS. 7A-7C illustrate a lever 756 that includes first and second cone-shaped plugs 782*a* and 782*b* that align with the corresponding first and second suction control openings 572*a* and 572*b*, respectively. In one embodiment, the plugs 782*a* and 782*b* can be configured to provide a tight seal between the plate 158 and the gasket 570 in the closed positioned (FIG. 7A). The plugs 782*a* and 782*b* can partially block the suction control openings 572*a* and 572*b* in one or more intermediate positions. For example, in FIG. 7B, the first and second plugs 782*a* and 782*b* cover the first and second suction control openings 572*a* and 572*b* over a diameter d1 and d2, respectively. In the orientation of 7C, the first plug 782*a* covers a smaller diameter d3 over the suction control opening 572*a*, and the second plug 772*b* is completely removed from the suction control opening 572*b*. In at least some cases, the plugs 782*a* and 782*b* can provide an increased level of control when connected to the plate 158 described above with reference to FIGS. 6A-6C. In any of these embodiments, the plugs can be made from a gasket material (e.g., plastic or metal, or another suitable material).

Figure 8A:
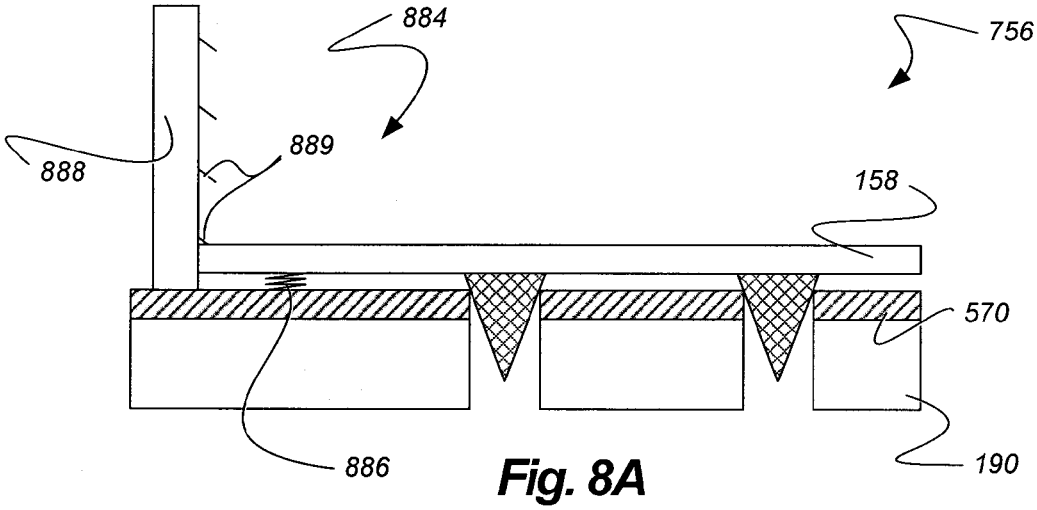
Figure 8B:
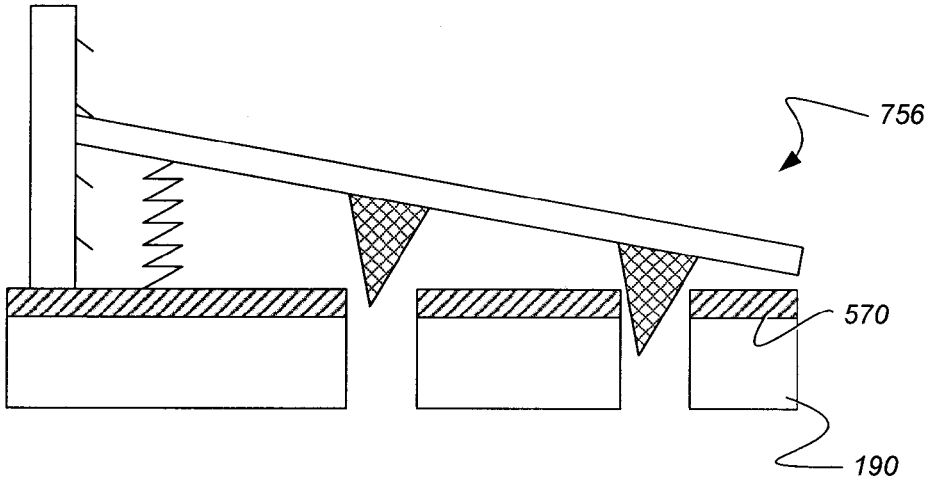
Figure 8C:
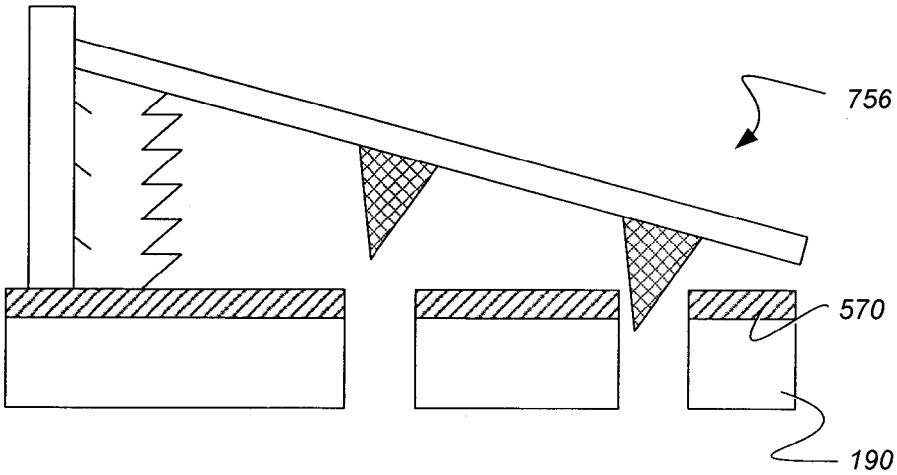

In some embodiments, the suction control device 157 can include one or more components for controlling and/or holding the orientation of the plate 158. FIGS. 8A-8C show a capstan mechanism 884 configured to hold the plate 158 of the lever 756 in the orientations of FIGS. 7A-7C. The capstan mechanism 884 includes a spring 886 and a ratchet bar 888 with grooves 889 configured to hold the plate 158 in each of the orientations of FIGS. 7A-7C as well as in other orientations. The user or operator can adjust the position of the plate 158 by raising or lowering the plate 158 into one of the grooves 889. The spring 886 can provide a force that counteracts a force created by the suction through the tubular member 190.

Although the embodiments illustrated in FIGS. 6A-8C illustrate several representative projections, surfaces, and configurations for controlling suction, other embodiments include projections with other shapes, surfaces, and/or configurations. For example, individual control openings 572 can be larger or smaller or have different shapes and/or sizes with respect to other suction control openings. In addition, embodiments that employ plugs can also have any of a myriad of different shapes or sizes for controlling suction through a suction control material. For example, rather than a conical shape, embodiments of the plug can be cylindrical or semi-spherical.

In other embodiments levers, gaskets, and related mechanisms for opening/closing suction control openings can have other configurations. In one embodiment, a lever can be configured to cover the suction control openings by a sliding mechanism rather than a pivot mechanism. In another embodiment, the gasket 570 can be coupled to the plate 158 instead of the tubular member 190. In other embodiments, other types of hinges and/or fastening mechanisms can be employed. In still further embodiments the suction control device can be carried by the tubular member 190 rather than the handle 150, but can still be accessible by the user such that the control device can be operated while simultaneously operating the extractor.

Components of the extractor 100 in accordance with embodiments of the present technology can be manufactured from a variety of materials. For example, the tubular member 190 can be manufactured from metal, such as from a sheet of cold rolled steel. The extractor head 102, the handle 150, and related components can each be made from an injection molded plastic, including for example, thermoplastics and thermosets. In one embodiment, the extractor head 102, or at least a portion of the extractor head 102, can be transparent to allow a user to view fluid moving through the extractor head 102 during use. In some embodiments, the related components of the extractor head 102 and/or the handle 150 can be made from different materials. For example, the extractor port housing 106 can be manufactured from a different material than the body of the extractor head 102.

From the foregoing, it will be appreciated that specific embodiments have been described herein for purposes of illustration, but that various modifications may be made without deviating from the spirit and scope of the disclosure. For example, the extractor described herein has a handle and an extractor head that are detachable from the tube; however, in some embodiments, two or more of these components can be integrated into a single component, such as a tube that is integrated into the handle to form a single component. In other embodiments, an extractor head as described herein can be configured so that it can be adapted to fit to a conventional extractor. For example, a conventional extractor head can be removed and then replaced or retrofitted with an embodiment of the extractor head.

The methods disclosed herein include and encompass, in addition to methods of making and using the disclosed devices and systems, methods of instructing others to make and use the disclosed devices and systems. In some embodiments, such instructions may be used to teach the user how to operate the extractor according to the various embodiments of operations. For example, the operating instructions can instruct the user how to provide any of the operational aspects of FIGS. 4A and 4B, such as a squeegee function. Similarly, the operating instructions can instruct the user how to control or adjust suction while operating the extractor, such as by controlling embodiments of the lever 156. In some embodiments, methods of instructing such use and manufacture may take the form of computer-readable-medium-based executable programs or processes.

Moreover, aspects described in the context of particular embodiments may be combined or eliminated in other embodiments. Further, although advantages associated with certain embodiments have been described in the context of those embodiments, other embodiments may also exhibit such advantages, and not all embodiments need necessarily exhibit such advantages to fall within the scope of the disclosure. The following examples provide further embodiments of the disclosure.

We claim:

1. An extractor head for removing fluid from an at least partially liquid-saturated surface, the extractor head comprising:

an extractor port housing having a cavity positioned to be coupled to a vacuum source, the extractor port housing including— a recessed surface aligned with an elongated axis, and individual openings extending through the recessed surface and in fluid communication with an interior suction cavity of the extractor port housing, and wherein the extractor port housing further includes first and second lips each adjacent to an opposing side of the recessed surface, aligned with the elongated axis, and having a fixed shape that is generally convex relative to the recessed surface, and wherein the first lip is configured to provide an edge that directs liquid from the at least partially liquid-saturated surface toward the recessed surface when the first lip contacts the at least partially liquid-saturated surface with a contact force greater then another contact force applied to the second lip.

2. The extractor head of claim 1 wherein:

the first lip is configured to provide a first squeegee function when a portion of the first lip is contacting and moving in a first direction across the at least partially liquid-saturated surface, and the second lip is configured to provide a second squeegee function when a portion of the second lip is contacting and moving in a second direction across the at least partially liquid-saturated surface.

3. The extractor head of claim 1 wherein the individual openings are elongated, aligned with the elongated axis, and arranged in staggered rows that are also aligned with the elongated axis.

4. The extractor head of claim 1 wherein the recessed surface is concave and shaped to form a depression.

5. The extractor head of claim 1 wherein the fixed shape of the first lip is the same as the fixed shape of the second lip.

6. The extractor head of claim 1 wherein the first and second lips each have a rounded surface.

7. The extractor head of claim 1 wherein the openings are configured to draw the liquid from the first lip into the suction cavity via an applied suction force.

8. The extractor head of claim 1 wherein the first lip is further configured to direct the liquid toward the recessed surface when the first lip is contacting the at least partially saturated surface and the second lip is not contacting the at least partially liquid-saturated surface.

9. An extractor, comprising:

a tubular member having a first end, a second end opposite the first end, and an outlet configured to be operably coupled to a vacuum source;

a handle coupled to the tubular member towards the first end and including a suction control device positioned to control a fluid flow rate at which fluid is drawn through a portion of the tubular member, wherein the suction control device is positioned such that a user can simultaneously operate the suction control device to control the fluid flow rate and operate the extractor to remove liquid from a flooring surface; and an extractor head configured to be operably coupled to the tubular member at the second end, wherein the extractor head comprises— a recessed surface having openings extending through the recessed surface and configured to be in fluid communication with the tubular member, and first and second lips each adjacent to opposite sides of the recessed surface, wherein each of the first and second lips has an outer surface with a fixed shape that protrudes outwardly relative to the recessed surface, and wherein the outer surface is configured to direct the liquid from the flooring surface toward the recessed surface when (1) one of the first and second lips contacts the flooring surface with a contact force and (2) the other one of the first and second lips does not contact the flooring surface or contacts the flooring surface with lesser contact force.

10. The extractor of claim 9 wherein:

the tubular member has a wall, the tubular member comprises suction control openings extending through the wall, and the suction control device is configured to adjustably cover the suction control openings.

11. The extractor of claim 10 wherein the suction control device comprises a plate positioned to adjustably cover the suction control openings.

12. The extractor of claim 10 wherein the suction control device further comprises a gasket configured to adjustably cover the suction control openings.

13. The extractor of claim 10 wherein the suction control device further comprises:

a plate positioned to adjustably cover the suction control openings;

a lever arm pivotally coupled to the plate and a body of the handle; and a finger tab coupled to the lever arm.

14. The extract of claim 10 wherein the suction control device further comprises:

a plate positioned to adjustably cover the suction control openings; and a capstan mechanism configured to hold the plate in at least a first fixed orientation and a second fixed orientation, wherein— in the first orientation, the capstan mechanism is configured to substantially cover the suction control openings, and in the second orientation, the capstan mechanism is configured to at least partially uncover at least a portion of the suction control openings.

15. The extractor of claim 9 wherein the recessed surface is concave and shaped to form a depression.

16. The extractor of claim 9 wherein:

the first lip is configured to provide a first squeegee function when the extractor head is moved in a first direction across the flooring surface, and the second lip is configured to provide a second squeegee function when the extractor head is moved in a second direction across the flooring surface.

17. The extractor of claim 9 wherein the outer surface of each of the first and second lips is rounded.

18. An extactor, comprising:

a tubular member having a first end, a second end opposite the first end, and an outlet configured to be operably coupled to a vacuum source, wherein the tubular member includes a wall and a plurality of suction control openings extending through the wall, wherein the plurality of suction control openings includes a first opening and a second opening;

a handle coupled to the tubular member towards the first end and including a suction control device positioned to control a fluid flow rate at which fluid is drawn through a portion of the tubular member, wherein the suction control device is positioned such that a user can simultaneously operate the suction control device to control the fluid flow rate and operate the extractor to remove fluid from a flooring surface, wherein the suction control device includes— a plate pivotally coupled to the tubular member such that the plate pivots at least between a first position and a second position, and a first plug element on the plate and projecting toward the tubular member, a second plug element spaced apart from the first plug element on the plate and projecting toward the tubular member, wherein in the first position the first plug element partially closes the first opening and the second plug element completely covers the second opening, and wherein in the second position the first plug element is completely removed from first opening and the second plug element only partially extends into the second opening; and an extractor head configured to be operably coupled to the tubular member at the second end wherein the extractor head comprises— a recessed surface having openings extending through the recessed surface and configured to be in fluid communication with the tubular member, and first and second lips each adjacent to opposite sides of the recessed surface, wherein each of the first and second lips an outer surface with a fixed shape that protrudes outwardly relative to the recessed surface.

19. The extractor of claim 18 wherein each of the first and second plug elements have a conical shape.

* * * * *